US005398615A

United States Patent [19]

Johnsson et al.

[11] Patent Number: 5,398,615

[45] Date of Patent: Mar. 21, 1995

[54] METHOD AND AN APPARATUS FOR SEPARATING SUBCOMBAT UNITS

[75] Inventors: Stig Johnsson, Karlskoga; Lars Paulsson, Kristinehamn; Anders Holm; Sten Johansson, both of Karlskoga, all of Sweden

[73] Assignee: Bofors AB, Karlskoga, Sweden

[21] Appl. No.: 82,480

[22] Filed: Jun. 28, 1993

[30] Foreign Application Priority Data

Jun. 30, 1992 [SE] Sweden ..... 9202012

[51] Int. Cl.[6] ..... F42B 12/58

[52] U.S. Cl. ..... 102/489; 102/393

[58] Field of Search ..... 102/393, 489, 382, 384, 102/385, 386, 387

[56] References Cited

U.S. PATENT DOCUMENTS

| | | | |
|---|---|---|---|
| 3,276,367 | 10/1966 | Edwards | 102/393 |
| 4,524,694 | 6/1985 | Boeder | 102/489 |
| 4,676,167 | 6/1987 | Huber et al. | 102/393 |
| 4,856,432 | 8/1989 | Synofzik | 102/489 |
| 4,920,887 | 5/1990 | Frehaut et al. | 102/489 |
| 5,054,400 | 10/1991 | Pineau et al. | 102/489 |
| 5,107,767 | 4/1992 | Schneider et al. | 102/393 |

FOREIGN PATENT DOCUMENTS 3506889 8/1986 Germany .

*Primary Examiner*—David Brown

*Attorney, Agent, or Firm*—Pollock, Vande Sande & Priddy

[57] ABSTRACT

A method of separating from one another subcombat units transported by a rotationally-stabilized carrier body to a predetermined target area. The method comprises the steps of:

ejecting the subcombat units and a plurality of masses or bodies from the carrier body;

utilizing rotational energy from the rotationally-stabilized carrier body to generate axially directed separation forces in the masses or bodies, the separation forces acting concentrically in relation to a common center axis of the carrier body; and separating the subcombat units from one another so that they spread out and each cover a predetermined portion of a target area by utilizing the separation forces in the masses or bodies to cause the separation of the subcombat units after their ejection from the carrier body.

21 Claims, 8 Drawing Sheets

METHOD AND AN APPARATUS FOR SEPARATING SUBCOMBAT UNITS

FIELD OF THE INVENTION

The present invention relates to a method and an apparatus for mutually separating subcombat units which are transported, by a rotation-stabilized vehicle or body such as a shell, to a predetermined target area where they are ejected from the carrier vehicle or body and then separated and spread so that they each cover a determined part of the target area.

BACKGROUND OF THE INVENTION

Subcombat units which may be used with the present invention may be of a plurality of different types. For example, they may be of the type which is described in Swedish printed application No. 464834 corresponding to U.S. Pat. No. 5,088,419. Such combat units include both a hollow charge effect unit, a target detector, and special flip-out carrier surfaces which, after ejection from the carrier vehicle or shell, impart to the subcombat unit a helical trajectory towards ground level. In such subcombat units, it is, thus, vital that the subcombat units transported in one and the same shell are separated and spread in accordance with a predetermined pattern so that their different helical trajectories entail that together they will cover the largest possible target area without unnecessary overlap or interjacent areas which are not covered. In addition, the subcombat units must not impede one another.

In many cases, it is also desirable that the subcombat units can be separated in such a manner that they retain their rotation, and that the rotation vector deviates minimally from the center line. The reason for this may be an intention that the subcombat units are substantially to rotate about the center line throughout the entire period up to the moment when they are to give effect.

The subcombat unit which is described in the above-mentioned printed application is, as already mentioned, of the hollow charge effect type, but this particular factor is of no consequence in this context. Quite the contrary, the present invention relates to all subcombat units, including mines which are transported to the target area in a rotation-stabilized carrier body or vehicle and which are ejected therefrom either as a unit and which must thereafter be separated from one another in accordance with a predetermined pattern, or alternatively which must thereafter be separated from other parts by degrees as they depart from the carrier vehicle or body.

It has previously been proposed in the art to separate subcombat units of the type contemplated here by means of small pyrotechnical changes. However, such a method requires time-control ignites in order to give the desired separation pattern, and time-control igniters do not always give the desired result.

SUMMARY OF THE INVENTION

In accordance with the present invention, use is now made of the rotation energy which acts on unspecific bodies or masses ejected together with the subcombat units so as to generate the desired separation force. The separation is effected in such a manner that the rotation vector acting on the carrier projectile is retained given that it has been possible to cause the separation forces to act concentrically in relation to the common center line of the subcombat units.

To sum up, the present invention may thus be described as relating to a method of separating from one another subcombat units which are transported by a rotation-stabilized carrier vehicle or body such as, for example, a shell, to a predetermined target area. In the target area the subcombat units are ejected from the carrier body. After ejection, the subcombat units separate from one another. Erection and separation result in the subcombat vaits being a portion of the pertinent target area. The rotation energy acting on specific bodies or masses ejected, together with the subcombat units from the carrier body, is used to generate concentrically-acting, axially-directed separation forces in relation to the common center axis of the subcombat units.

This separation effect may, according to the present invention, be generated with the aid of two different apparatuses. This implies that the present invention also encompasses these particular embodiments.

Moreover, ejection of the subcombat units may take place in a manner such that the parts are separated off as they depart from the carrier body. Alternatively all subcombat units can be ejected out in such a manner that they depart from the carrier body as a continuous unit which does not begin to be separated into its different component parts until it is completely outside the carrier body.

Irrespective of which of these alternatives is selected, both of these variations are based on the fact that the available rotational energy is utilized for a radial displacement away from the common center axis of the subcombat units of bodies or masses disposed concentrically about this axis and whose radial displacement is deflected into axially directed separation forces acting between or among the subcombat units.

According to the first variation on this fundamental principle, the radially displaceable body or masses are given the form of wedges which are disposed concentrically about the center axis and are displaceable radially away from the center axis after ejection of the subcombat units out of the carrier body. The axially thickest portions of the wedges are turned inwardly towards the center where, in the initial position, they are located in a space adapted therefor. Their radially outer thinner portions, which account for the major portion of their mass, closely abut between those parts which are to be separated, for example, two subcombat units or, alternatively, one subcombat unit and a shell bottom. Moreover, the thinner portions closely abut along their outer periphery against the inner wall of the carrier shell.

In one particularly preferred embodiment of these wedges, they are in the form of a circular wheel composed of a plurality of independent segments. The major mass of the wheel lies along its thinner outer periphery. The greatest thickness in the axial direction, that is, its cuneiform portion, consists of wedge-shaped projections directed radially in towards the center axis.

The wheel configuration is superior, since it prevents any displacement inwardly towards the center of the mutually completely free wedges, while outward displacement is prevented by the abutment of the wedges against the inside of the carrier shell. However, it is not necessary that tile closed wheel form be created only by the wedges. For example, separate inter lays may be present between the wedges, heels or the like included in the adjacent subcombat unit.

When the wedge segments are thrown outwardly by the centrifugal force, their inner, cuneiform projections will urge themselves in between the subcombat units along that periphery where the original, thinner peripheral parts of the wedge segments were located. In such instance, the subcombat units are actuated in the axial direction and the desired axial separation is realized with insignificant alteration of the rotation of the parts.

Certain of these wedge segments may, moreover, be provided with catches or similar means which ensure that the subcombat units are held together until such time as their wedges have begun to leave their places.

If the outer periphery of the wedges in the initial position abuts against the inside of the carrier body, an efficient locking of the entire system will be achieved. This is because the system is locked inwardly, in that the outer parts off the wedge segments together form enclosed annular unit.

In the second variation of the present invention, displaceable part masses are employed instead of wedges. Each mass is united with a first shaft which is radial in relation to the rotation. Each shaft is in turn pivotally connected in its innermost region to two shafts disposed on either side of the first shaft. The two shafts are connected with one axial main direction, but at an angle which is less than 90° relative to the first shaft. The outer ends of the two shafts are rotatably but non-displaceably in engagement with each respective sub-combat unit proximal their outer periphery.

A number, preferably at least three, of these part mass devices are distributed about the distribution periphery between the pertinent subcombat units.

In this second variation of the present invention, the different parts act as a gear system, in which event the radial displacement of the part masses, initiated by the centrifugal force, gives a similarly radial displacement of the first shaft. The dispalcement of the first shaft in turn, displaces its pivotal connection with the two remaining shafts so that at the angle between the shafts increases in this event the subcombat units or the like, against which both of the second shafts abut, will be forced away from one another.

This variation of the present invention can also be locked in that the part masses, up to the point when the subcombat units are ejected out of the carrier body, abut against the inside thereof.

The variation with the wedges and the variation employing the gear system can both be used in an embodiment of the present invention in which the parts are separated as they depart from the carrier body and an embodiment in which all parts are ejected out as a unit which is then separated into different parts only when this unit has wholly departed from the carrier body. Whichever of these variations is relevant is primarily a question of how and at what speed the ejection is to take place, since a very rapid ejection entails that all subcombat units, and even the shell bottom, will depart from the carrier body as a unit.

BRIEF DESCRIPTION OF THE DRAWINGS

The present invention is defined in the appended claims, while the different variations thereof are described in greater detail hereinbelow, with particular reference to the accompanying drawings. In the accompanying drawings:

DESCRIPTION OF PREFERRED EMBODIMENTS

Figure 1:
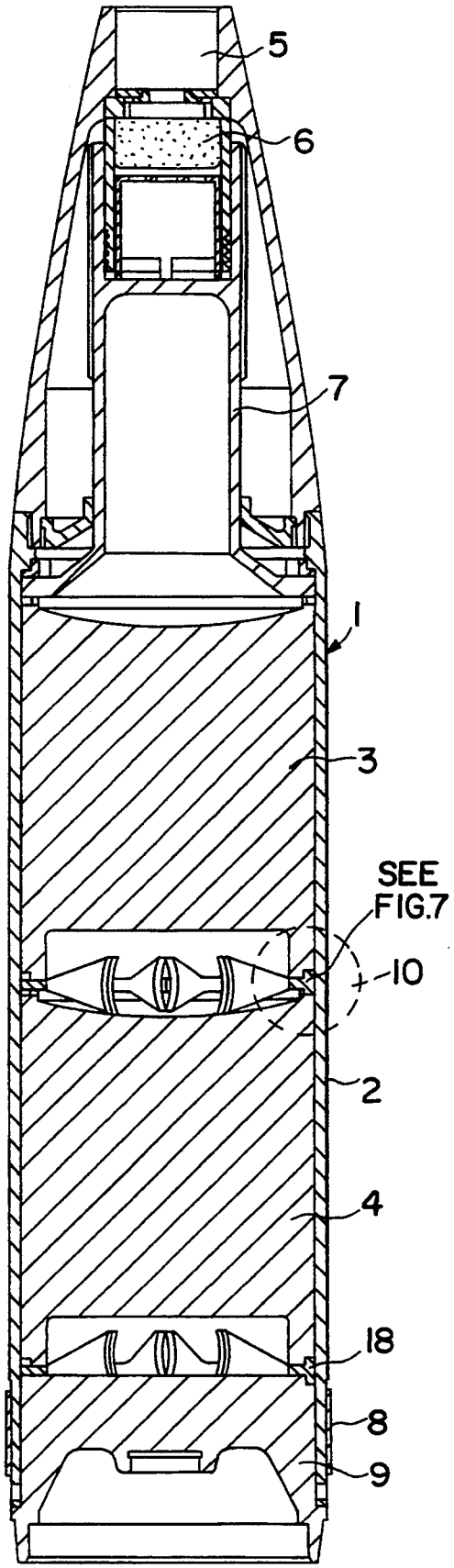
FIG. 1 is a longitudinal section through a shell containing two subcombat units.

In FIGS. 1–7 and 9, corresponding parts and details have been given the same reference numerals. However, FIG. 9 includes a number of details which carry their own references.

Figure 6:
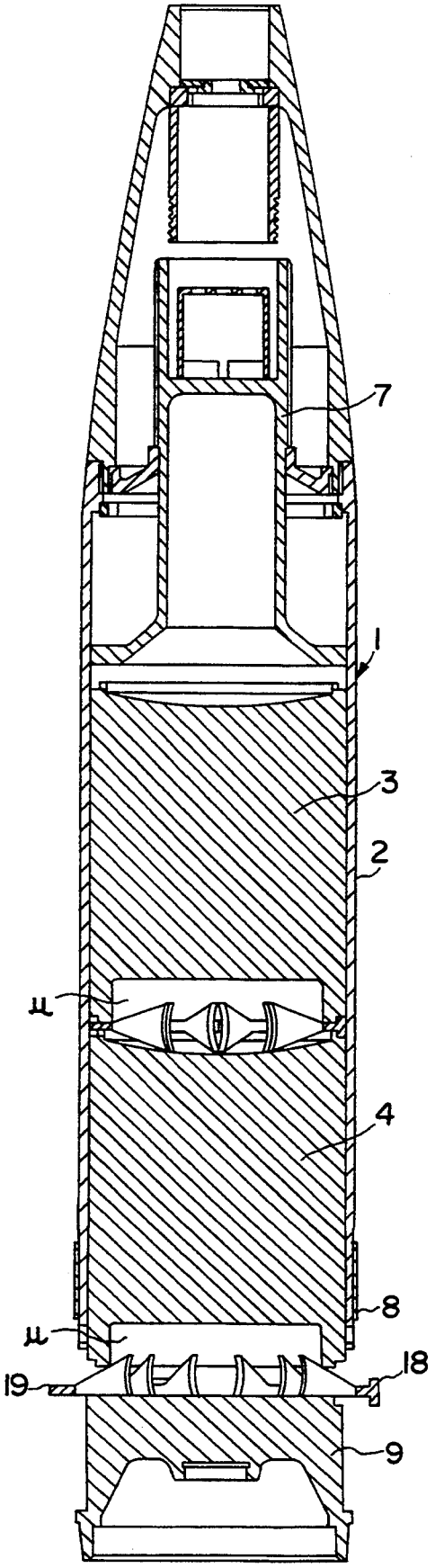
FIG. 6 is a longitudinal section through the shell of FIG. 1 in that position where the ejection of the subcombat units has commenced.
Figure 7:
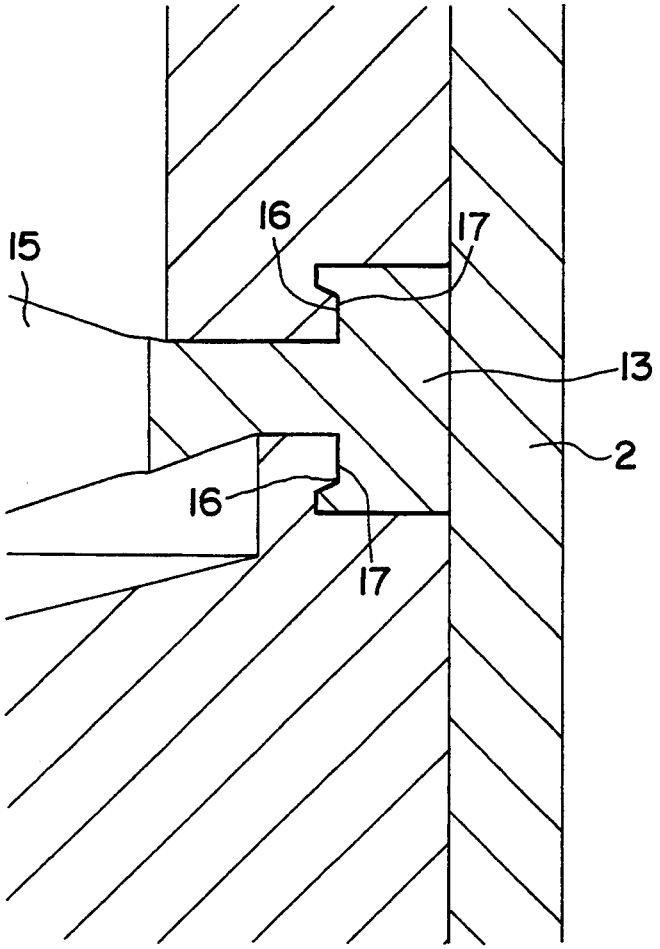
FIG. 7 shows a detail on a larger scale marked VII from FIG. 1.

FIGS. 1 and 6 show a shell 1 in whose cylindrical portion 2 two subcombat units 3 and 4, respectively are ejectably disposed. A fuze 5 is disposed in the nose of the shell. The fuze determines when the subcombat units are to be ejected and then initiates a gas-generating ejection charge 6 which in turn displaces a ram 7 in a direction towards the rear end 8 of the shell. There, the ram 7 first ejects the shell bottom 9 out of the cylindrical portion of the shell and, thereafter, the two subcombat units 3 and 4. By utilizing an ejection arrangement of the above-described type, it is possible to avoid the complication that the gases from the ejection charge 6 act directly on the subcombat units. The ram 7 is first accelerated so as to impart to the shell bottom 9 and the subcombat units 3 and 4 sufficient ejection velocity. Thereafter, the ram is retarded and retained in the shell body, while the subcombat units continue out of the shell as a result of inertia.

Figure 2:
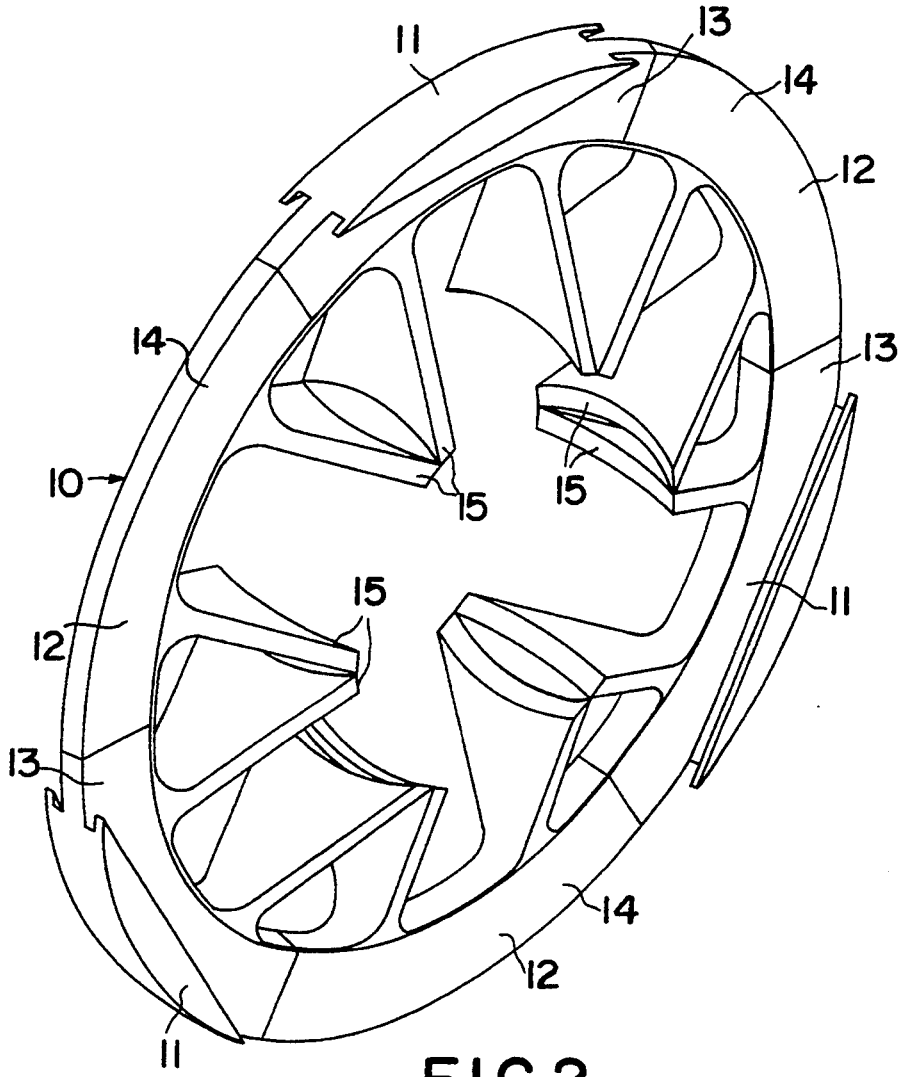
FIG. 2 is an oblique projection of complete double-action wedge set in the form of a number of wedge segments.
Figure 3:
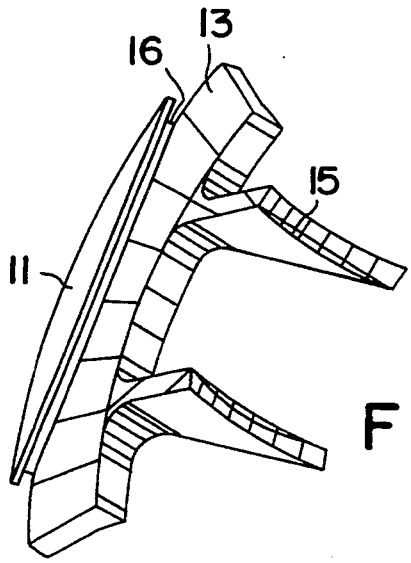
FIG. 3 is an oblique projection of the wedge segments according to FIG. 2.
Figure 4:
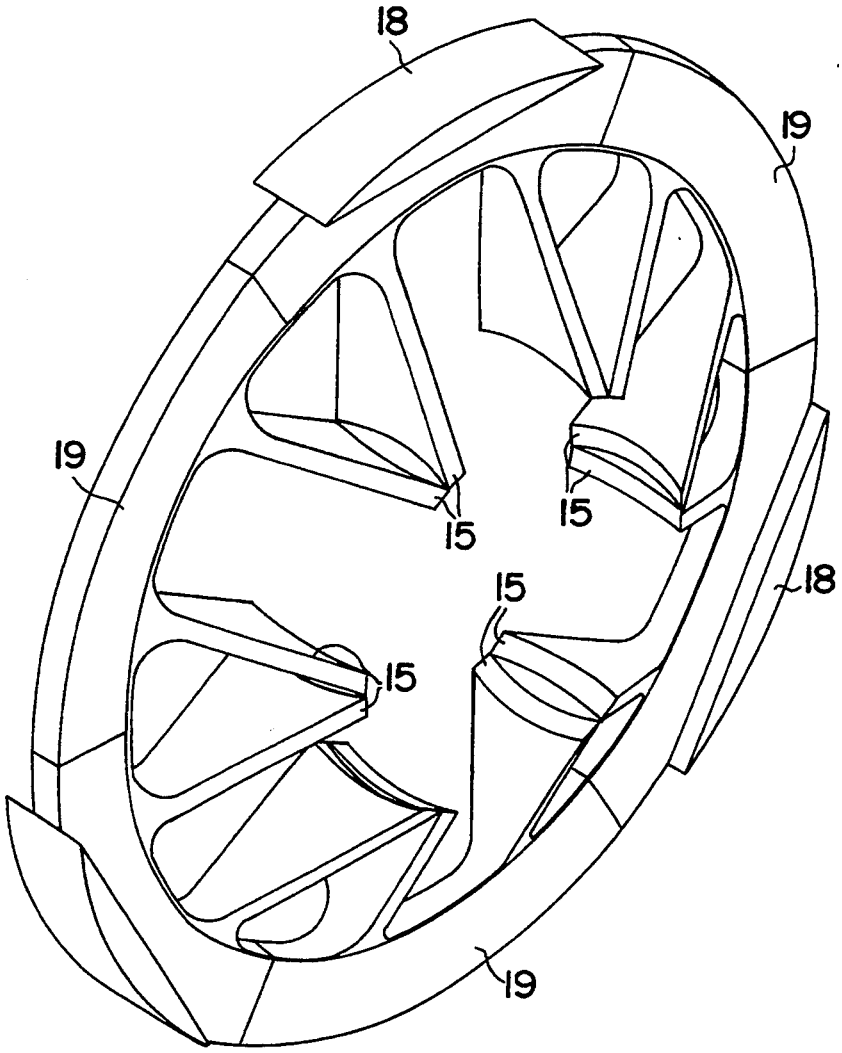
FIG. 4 is an oblique projection of a complete, single-sided wedge set in the form of a number of wedge segments.
Figure 5:
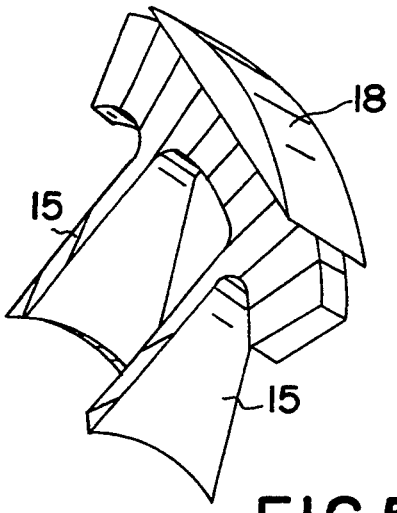
FIG. 5 is an oblique projection of one of the wedge segments according to FIG. 4.

Between the subcombat units 3 and 4 there is disposed a first set of separation bodies or separation wedges of the type illustrated in FIGS. 2 and 3. As is apparent from FIG. 2, the separation wedges shown in this figure together form a closed ring or annulus 10 consisting of a number of wedge segments of two types 11 and 12, respectively. Each wedge segment 11 and 12 consists of an outer portion 13 and 14, respectively. The outer portions all together form a closed unit and contain the major portion of the mass. The wedge segments also include projections 15 extending in a direction towards but not fully reaching the center. Before the subcombat units the shell bottoms have been shot out of the cylindrical portion 2 of the shell, the wedge segments are prevented from moving outwardly by the inside of the shell and, in this case, inwardly because together they form a closed ring. As is apparent from the Figures, the wedge-shaped projections are, in this variation, double-sided cuneiform. Also, in the initial position, the wedge-shaped projections lie in specifically adapted cavities.

The wedge segments 11 are provided, along parts of their outer region 13, with catches 16. The catches grasp corresponding grips 17 in the subcombat units and function as most clearly shown in FIG. 7. With the type of ejection ram for the subcombat units shown in FIGS. 1 and 6, there is, namely a risk that the cylinders will be separated inside the carrier shell because the wedges are forced by centrifugal force against the inside of the carrier shell. In such an instance, a risk also exists that the friction generated would retard the second, inner, or forward subcombat unit seen in the direction of flight, while the first ejected or rear subcombat unit, which is not retarded, would separate from the retarded unit in an uncontrolled manner. This can, be prevented employing the above-described catch.

Between the rear, first ejected subcombat unit 4 and the shell bottom 9 there are disposed single-sided cuneiform separation bodies 18 and 19. The design of the bodies 18 and 19, apart from the single-sided wedge shape and lack of catches, wholly corresponds with the variations illustrated in FIGS. 2 and 3.

Differences between the separation bodies or wedges depend, on the one hand, on different available spaces and, on the other hand, on the fact that, on optimation of a design, it may be motivated to give them different detail design appearances. However, the separation effect is fundamentally the same.

When the separation bodies or wedges have passed out from the shell body, the separation bodies will, by centrifugal force, be flung outwardly. In this event, the wedge-shaped projections force apart the subcombat units or the one subcombat unit and the shell bottom, respectively.

As a result of the symmetry created by the separation parts, the resultant of the separating forces will pass through the center of the shell. This entails that the axis of rotation is not influenced, implying that no pendulum-initiated forces act on the pertinent subcombat units.

In the position illustrated in FIG. 6, the ram 7 has completed its action and imparted to the subcombat units 3 and 4, a sufficient ejection velocity. The ram 7 has been arrested and the shell bottom 9 has departed from the cylindrical portion 2 of the shell. The separation bodies or the wedges 18 and 19 have departed from the inside of the shell body and been thrown outwardly by rotation forces and begin to force apart the shell bottom from the subcombat unit 4.

Figure 8:
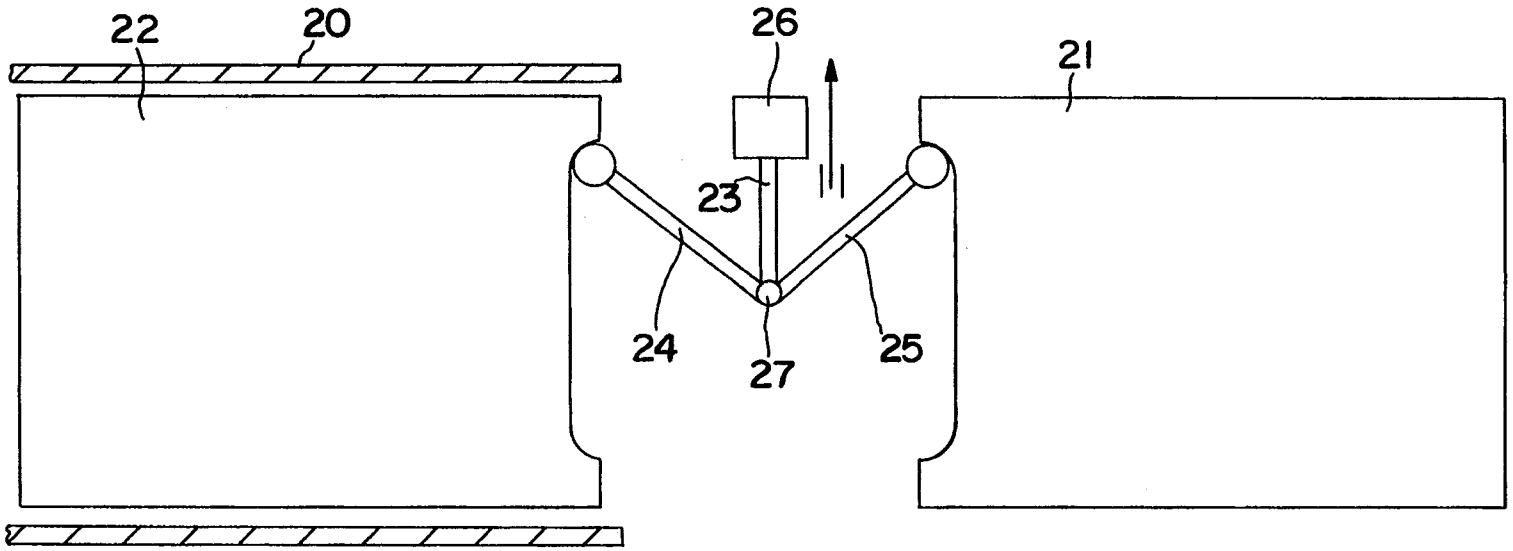
FIG. 8 is a schematic diagram clarifying the second variation of the present invention.

The schematic illustration of an embodiment of a second variation of the present invention illustrated in FIG. 8 shows the rear portion of the cylindrical part 20 of a shell. FIG. 8 shows that position when the first 21 of two subcombat units 21 and 22, respectively, have departed from the interior of the shell. The separation mechanism described hereinbelow is one of several, and preferably at least three mechanisms disposed symmetrically in relation to the circumference of the subcombat units.

The apparatus according to the present invention consists of a part mass 26 disposed at the outer end of a first, radially disposed shaft 23. At the inner end of shaft 23, two other shafts 24, 25 are pivotally connected on each side but in the same plane of division so that they make an angle which is preferably greater than 45° but definitely less than 90° with the first shafts 23. The outer ends of the shaft 24 and 25 non-displaceably but rotatively against the subcombat units 21 and 22, respectively, close to their outer periphery.

When the ejection of the subcombat units 21 and 22, respectively, has reached the position illustrated in FIG. 8, the mass 26 has become free of the inside of the shell casing 20 and begun to be forced outwardly by rotation forces. The pivotal point 27 between the shaft 23, 24 and 25 then moves outwardly and the angle between the shafts increases towards 90°. Next the subcombat units are then forced away from one another. Since there are several symmetrically disposed linkage mechanisms of the above-described type, the separation will influence the rotation of the subcombat units but insignificantly. The abutment of the shafts 24 and 25, respectively, against the subcombat units 21 and 22, respectively, may be in the form of balls which rest in specifically adapted recesses. After completed separation of the subcombat units, the linkage mechanisms, such as the wedges, are flung radially outwardly by the centrifugal forces as a result, the wedges will never come in a position to impede the subcombat units.

Figure 9:
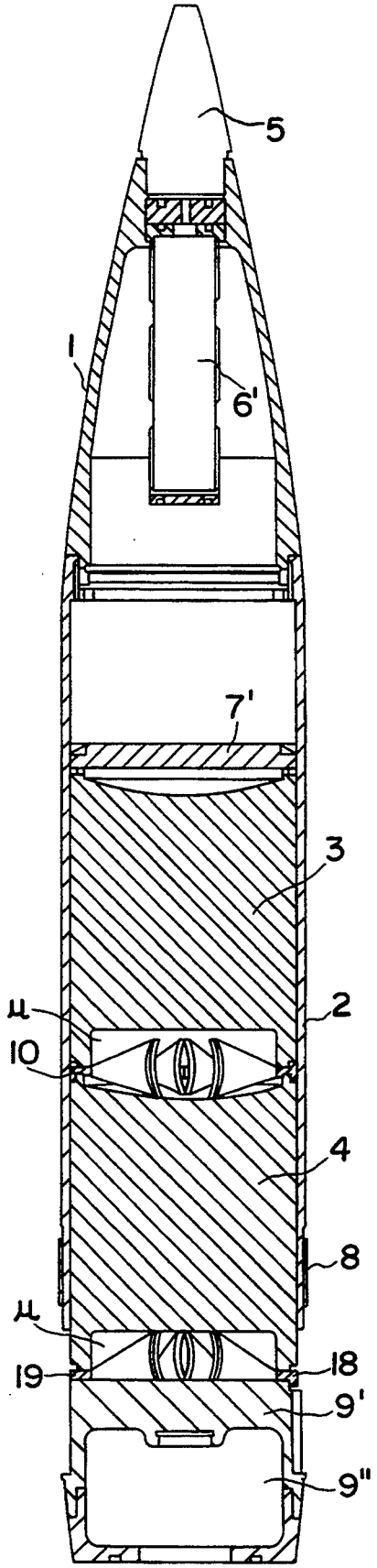
FIG. 9 is a longitudinal section through a shell with a different ejection function which gives an ejection of all subcombat units and the shell bottom as a unit. The figure shows the position in which the ejection has commenced.
Figure 11:
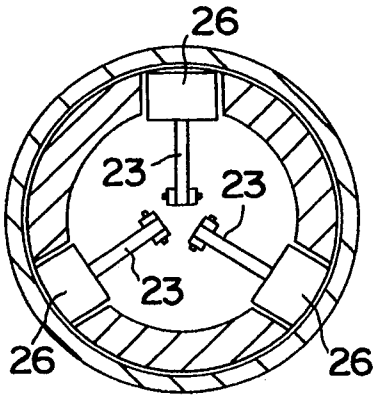
FIG. 11 represents a cross-section view of the embodiment shown in FIG. 10 along the line XI shown in FIG. 10.
Figure 10:
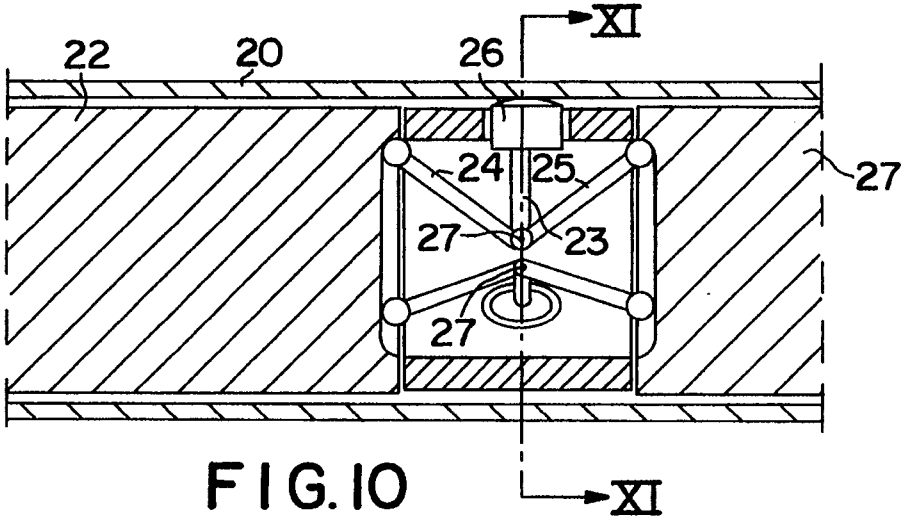
FIG. 10 represents a longitudinal-section view of an embodiment of the second variation of the present invention.
Figure 12:
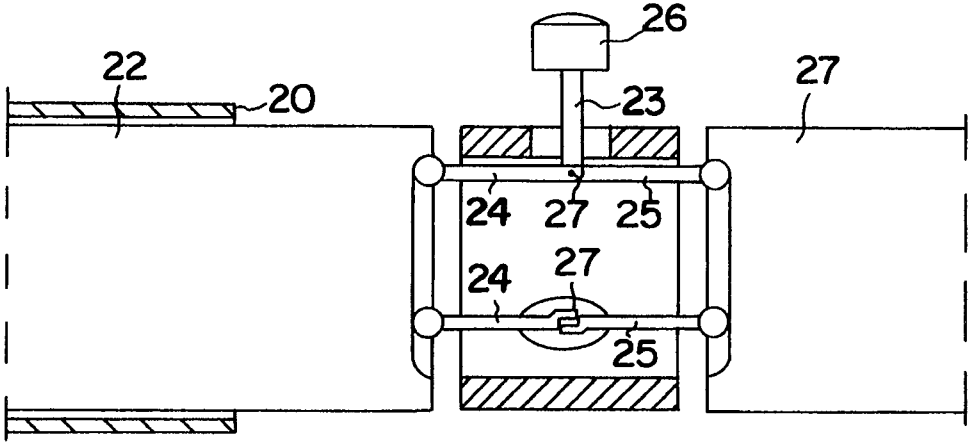
FIG. 12 represents a longitudinal-section view of the embodiment shown in FIG. 10 and FIG. 11 as the masses are being ejected from the carrier body.

The shell 1 illustrated in FIG. 9 is fitted with a fuse 5 which, at the time position illustrated in the Figure, has just initiated the gas generating pyrocharge 6' which forces the ram 7' towards the subcombat unit 3. In this alternative embodiment, there is no braking arrest for the ram 7' as a specific bottom position but, the ram accompanies the subcombat unit out of the carrier body. In addition, the gas generation of the ejection charge is selected such that the ram 7', the subcombat units 3 and 4 and the shell bottom 9' (which, in this embodiment, is provided with a base-bleed unit 9''), are ejected out as a unit or pack, in which the different parts are separated from one another in the previously described manner, only after the "pack" has wholly departed from the carrier body. The pressure from the gas generator 6' is, so large that the inertia forces of the shell bottom 9' and the subcombat units will be sufficient to prevent the wedges 18, 19 from acting. Only when the ram 7' has passed the end surface of the carrier shell 2 and the pressure and, thereby, the force have been rapidly reduced, will the wedges 18 and 19 separate the bottom 9' and the subcombat units 3 and 4 from one another.

After the separation, the different parts will adopt wholly individual fall trajectories toward the ground.

As described previously, the separation wedges are a guarantee that the separation between the parts take place without the subcombat units assuming a pendulum motion.

The present invention should not be considered as restricted to that described above and shown on the drawings, many modifications are conceivable without departing from the spirit and scope of the appended claims.

What we claim and desire to secure by letters patent is:

1. A method of separating from one another subcombat units transported by a rotationally-stabilized carrier body to a predetermined target area, the method comprising the steps of:

ejecting the subcombat units and a plurality of masses or bodies from the carrier body; and separating the subcombat units from one another so that they spread out and each cover a predetermined portion of a target area by utilizing rotational energy from the rotationally-stabilized carrier body acting on the masses or bodies to cause the separation of the subcombat units after ejection of the subcombat units from the carrier body, the rotational energy generating axially directed separation forces acting concentrically in relation to a common center axis of the subcombat units.

2. A method of separating from one another subcombat units transported by a rotationally-stabilized carrier body to a predetermined target area, the method comprising the steps of:

ejecting the subcombat units and a plurality of masses or bodies from the carrier body;

utilizing rotational energy from the rotationally-stabilized carrier body to generate axially directed separation forces in the masses or bodies, the separation forces acting concentrically in relation to a common center axis of the carrier body; and separating the subcombat units from one another so that they spread out and each cover a predetermined portion of a target area by utilizing the separation forces in the masses or bodies to cause the separation of the subcombat units after their ejection from the carrier body.

3. A method according to claim 2, further comprising the steps of:

providing the carrier body with a shell bottom; and ejecting all of the subcombat units and the shell bottom from the carrier body such that they are ejected from the carrier body as a unit whose parts are not separated until after the unit has been completely ejected from the carrier body.

4. A method according to claim 2, further comprising the steps of:

providing the carrier body with a shell bottom; and ejecting the subcombat units and the shell bottom out of the carrier body under such conditions that the subcombat units and the shell bottom separate as they are ejected from the carrier body.

5. A method according to claim 2, further comprising the step of:

preventing said separation forces from causing a movement of said masses or bodies until said subcombat units have been ejected from said carrier body by utilizing an inside of said carrier body.

6. A method according to claim 5, further comprising the steps of:

providing the carrier body with a shell bottom; and ejecting all of the subcombat units and the shell bottom from the carrier body such that they are ejected from the carrier body as a unit whose parts are not separated until after the unit has been completely ejected from the carrier body.

7. A method according to claim 5, further comprising the steps of:

providing the carrier body with a shell bottom; and ejecting the subcombat units and the shell bottom from the carrier body such that the subcombat units and the shell bottom separate as they are ejected from the carrier body.

8. A method according to claim 2, further comprising the steps of:

concentrically disposing the masses or bodies about the common center axis;

utilizing the rotational energy for radially displacing the masses or bodies away from the common center axis; and deflecting the radial displacement of the masses or bodies into axially directed separation forces acting between or among the subcombat units.

9. A method according to claim 8, wherein the deflection of the radially displaced masses or bodies into axially directed separation forces comprises the steps of:

forming said masses or bodies in the shape of wedges;

disposing the masses or bodies between the end walls of the subcombat units concentrically about the center axis; and displacing the masses or bodies out of the carrier body radially away from the center axis after ejection of the subcombat units.

10. A method according to claim 9, further comprising the step of:

preventing said separation forces from causing a movement of said masses or bodies until said subcombat units have been ejected from said carrier body by utilizing an inside of said carrier body.

11. A method according to claim 8, further comprising the step of:

providing said masses or bodies with a linkage mechanism; and deflecting said radial displacement of said masses or bodies into axially directed separation forces by utilizing said linkage mechanism.

12. A method according to claim 11, further comprising the step of:

preventing said separation forces from causing a movement of said masses or bodies until said subcombat units have been ejected from said carrier body by utilizing an inside of said carrier body.

13. An apparatus for separating subcombat units from one another, said apparatus comprising:

a rotationally-stabilized carrier body to be fired toward a target area;

subcombat units enclosed in the carrier body;

ejection means enclosed in the carrier body for ejecting the subcombat units, wherein the subcombat units are to be separated from one another in order to cover a predetermined portion of the target area;

a shell bottom secured in the vicinity of an end of the carrier body; and masses or bodies disposed between pertinent subcombat units and the shell bottom which are to be deflected therefrom, said masses or bodies being radially displaceable in relation to a common center axis of the subcombat units by rotation forces acting thereon, the displacement of said masses or bodies being deflected, by means adapted therefor, into axial separation forces acting between adjacent parts of said carrier body.

14. An apparatus according to claim 13, wherein said masses rest against an inside surface of the carrier body until the subcombat units have been ejected from the carrier body.

15. An apparatus according to claim 13, wherein said masses or bodies are distributed among at least three separation devices symmetrically and are concentrically disposed about the common center axis, and each of said masses or bodies comprises:

a part mass;

a first radial shaft connected with said part mass;

two second and third shafts pivotally connected with the inner end of said first shaft and resting on a respective point proximal to the periphery of the relevant subcombat unit, each of said second and third shafts forms an angle which is greater than 45° but less than 90° with said first radial shaft.

16. An apparatus according to claim 15, wherein said masses or bodies rest against an inside of the carrier body until the subcombat units have been ejected from the carrier body.

17. An apparatus according to claim 13, wherein said masses or bodies comprise:

wedges concentrically disposed between said parts of said carrier body along the periphery of said parts; thickest portions of said wedges are turned to face inwardly towards a center of said carrier body where they are located in an initial position in a space adapted therefor; and radially outer, thinner portions of said wedges closely abut between said parts of said carrier body.

18. An apparatus according to claim 17, wherein said masses or bodies rest against an inside of the carrier body until the subcombat units have been ejected from the carrier body.

19. An apparatus according to claim 17, wherein said wedges are together configured in a circular wheel made up of a plurality of independent segments having a major mass lying along a thinner outer periphery, said wedges have a largest thickness and a cuneiform portion consisting of projections both radially directed toward a center axis of the circular wheel.

20. An apparatus according to claim 19, wherein at least some of said independent segments include means along their outer periphery for interconnection with adjacent parts of said carrier body, each of said independent segments remains interconnected with said carrier body until the segment has been displaced.

21. An apparatus according to claim 19, wherein said masses or bodies rest against an inside of the carrier body until the subcombat units have been ejected from the carrier body.

* * * * *